US006213663B1

(12) United States Patent
Micaletti et al.

(10) Patent No.: US 6,213,663 B1
(45) Date of Patent: Apr. 10, 2001

(54) DENTIFRICE DISPENSING TOOTHBRUSH DEVICE

(76) Inventors: John Micaletti, 1709 Astor Ave., Oakbrook Terrace, IL (US) 60181; B. Bruce Abdullah, 303 E. 6th St., Hinsdale, IL (US) 60521

( * ) Notice: Subject to any disclaimer, the term of this patent is extended or adjusted under 35 U.S.C. 154(b) by 0 days.

(21) Appl. No.: 09/364,084

(22) Filed: Jul. 30, 1999

(51) Int. Cl.[7] ..... B43K 5/06
(52) U.S. Cl. ..... 401/176
(58) Field of Search ..... 401/176, 177, 401/179, 171, 268, 270, 275, 290, 132, 138, 140; 604/204, 208, 211, 232, 233, 234, 519, 57, 62; 433/80, 89; 15/167.1; 132/111

(56) References Cited

U.S. PATENT DOCUMENTS

| | | | | |
|---|---|---|---|---|
| 1,555,705 | | 9/1925 | Roberts . | |
| 2,199,877 | | 5/1940 | Cervera | 221/79 |
| 2,717,101 | * | 9/1955 | Handel | 222/80 |
| 3,417,762 | * | 12/1968 | Hall | 401/176 |
| 4,056,110 | | 11/1977 | Landsman | 132/84 |
| 4,643,724 | * | 2/1987 | Jobe | 604/232 |
| 4,693,622 | | 9/1987 | Booth | 401/191 |
| 4,787,765 | | 11/1988 | Kuo | 401/191 |
| 4,976,562 | | 12/1990 | Spivey et al. | 401/123 |
| 5,425,591 | | 6/1995 | Contreras et al. | 401/191 |
| 5,439,014 | | 8/1995 | Moussa | 132/311 |
| 5,464,294 | * | 11/1995 | Chee et al. | 401/269 |

FOREIGN PATENT DOCUMENTS

2175798 * 12/1986 (GB) .

OTHER PUBLICATIONS

Product wrapper/label: InstaBrush by BrushNow International.
Dental catalog page.

* cited by examiner

*Primary Examiner*—Gregory L. Huson
*Assistant Examiner*—Huyen Le
(74) *Attorney, Agent, or Firm*—Baniak Pine & Gannon

(57) ABSTRACT

A toothbrush apparatus for dispensing toothpaste to the bristles having a generally hollow head portion attached to a generally hollow receiving portion, capable of receiving and supporting a paste cartridge. The toothbrush also contains a handle portion, which is attached to the receiving portion at the opposite side of the head portion. The handle portion contains a plunger and a sliding button configured such that the plunger is located inside the head portion and is capable of sliding in and out of said head portion and receiving portion. A paste cartridge containing paste and having a hole and a stopper located at opposite ends is placed in the receiving portion such that the hole of the paste cartridge is connected to the head portion of the device. When the sliding button slides towards the head portion, the plunger moves inside the paste cartridge forcing the stopper to move towards the head portion and forcing paste from the cartridge toward the head portion and to the bristles of the toothbrush.

13 Claims, 2 Drawing Sheets

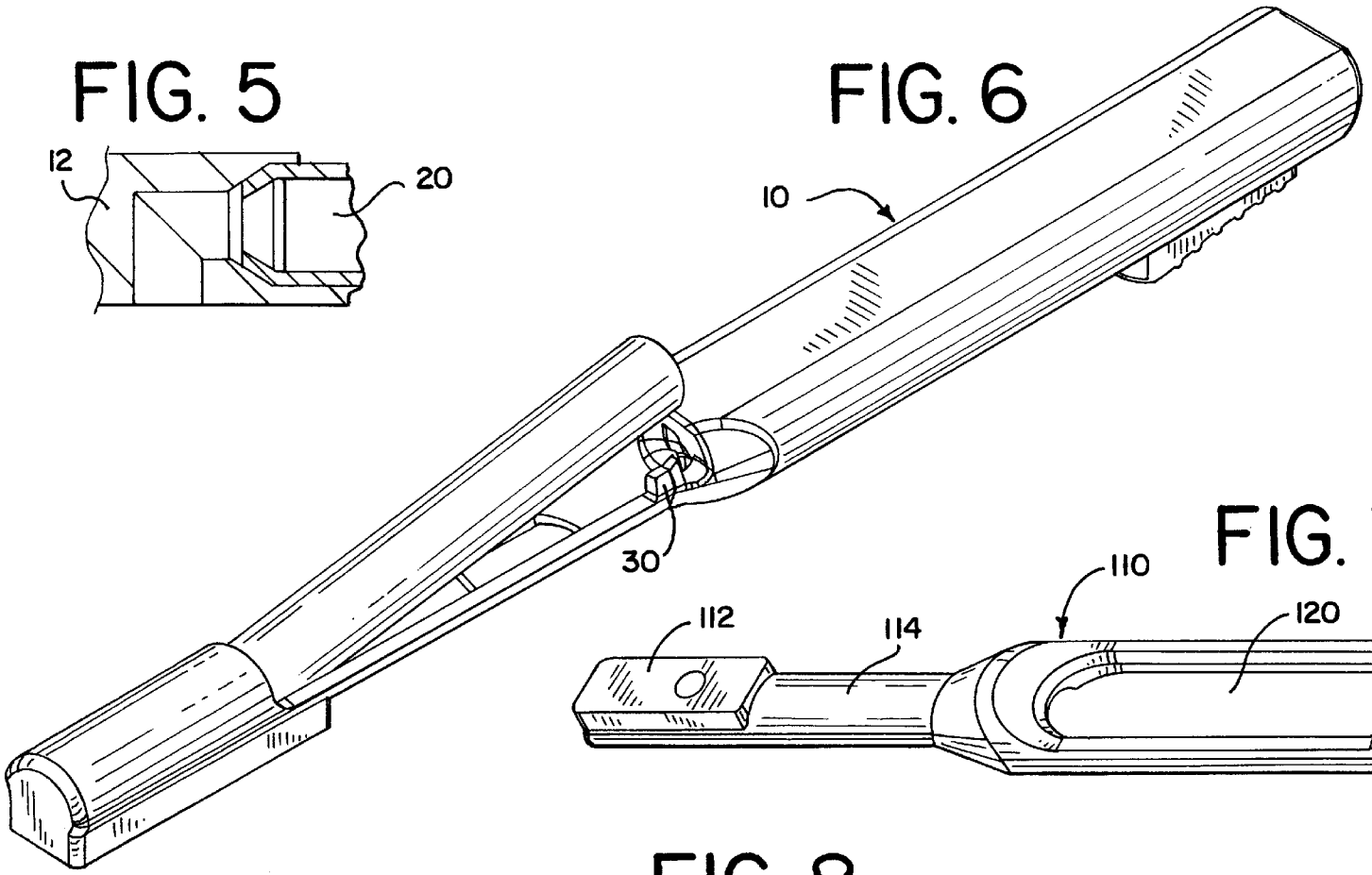
FIG. 6
FIG. 5
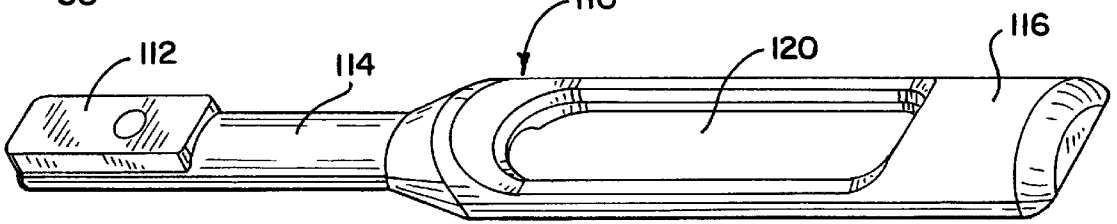
FIG. 7
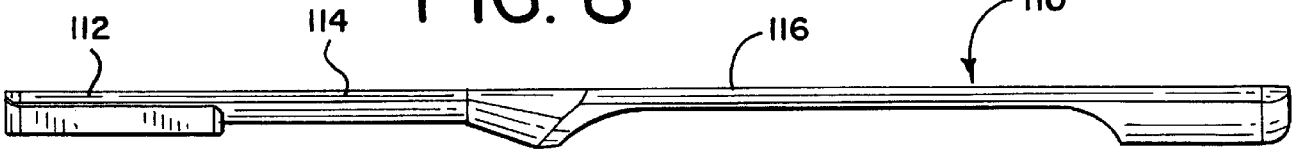
FIG. 8

DENTIFRICE DISPENSING TOOTHBRUSH DEVICE

TECHNICAL FIELD

The present invention relates to a novel dentrifice dispensing toothbrush device, and more specifically, the present invention relates to a novel dentrifice dispensing toothbrush device that can receive and contain a vial or cartridge containing dentrifice material or toothpaste and dispense the paste to the bristles of the toothbrush.

BACKGROUND OF THE INVENTION

Toothbrush devices have been in existence for many years. In general, the toothbrush contains a handle, a head portion and a bristle portion. In use, a dentrifice material or toothpaste is applied to the bristle portion of the toothbrush device and one's teeth can be cleaned or brushed. Applying toothpaste to the bristles can be messy and sloppy, and can be wasteful since some of the toothpaste may not be accurately applied to the toothbrush and end up on the toothbrush handle, on the toothbrush paste dispenser, or in the sink. Further, depending on the type of dispenser and how one dispenses the toothpaste, much of the toothpaste may remain in the dispenser when the dispenser is discarded adding to the waste of toothpaste.

After a number of teeth cleanings or brushings, the bristles on the toothbrush wear out and the toothbrush becomes ineffective and must be replaced. The toothbrush must then be discarded and a new toothbrush must be purchased. This creates even more waste since the handle of the toothbrush does not necessarily wear out.

A toothbrush that can accept a vial or cartridge filled with toothpaste, and deliver the toothpaste to the bristles of the toothbrush would alleviate the inherent mess and waste of the conventional toothbrush and toothpaste system. This toothpaste dispensing toothbrush would also have to be manufactured with a minimal number of parts to reduce the cost of the toothbrush, and the toothbrush would have to be easy to operate.

Although there are many toothpaste dispensing toothbrushes in the prior art, none possess all of the advantages of the present invention. U.S. Pat. No. 3,995,648 discloses a toothbrush and toothpaste supply container that utilizes a complex multi-piece piston and an internally threaded hollow barrel to dispense toothpaste to the bristles of the toothbrush. However, the device is configured such that toothpaste is placed directly into the hollow barrel instead of utilizing a vial or cartridge. The threaded hollow barrel makes it difficult to clean the residual toothpaste from the barrel prior to recharging the barrel with paste. Further, the multi-piece piston, which contains a disc-shaped assembly with two mating portions, a piston rod and an O-ring, would be expensive to manufacture and assemble compared to the cost of a standard toothbrush.

U.S. Pat. No. 4,693,622 discloses a combined toothbrush and toothpaste dispenser, which collapses into a compact unit for carrying convenience. The device includes a paste container held in by a cap that is placed over the container once the container is inserted. Upon activation of the device, toothpaste is delivered to the brush head, which can be extended out from the body casing or handle. However, it is not possible to easily insert and remove the paste cartridge by flexing the handle and loading the cartridge into the handle.

U.S. Pat. No. 5,439,014 discloses a toothbrush with a hollow cavity that can contain liquid dentrifice material. The toothbrush contains multiple pin-sized apertures within the handle of the brush to equalize the pressure inside the handle such that when the toothbrush is held upside down, the liquid dentrifice material flows to the brush head. However, paste dentrifice material will not flow as liquid dentrifice material, so it is not possible to use paste instead of liquid, nor is it possible to utilize a plunger to transfer or deliver the paste to the toothbrush head portion.

The prior toothbrush devices disclose complex toothbrush systems that appear to be able to deliver toothpaste to toothbrush bristles. The prior systems contain many unnecessary parts in order to either support a toothpaste cartridge or to deliver the toothpaste to the toothbrush head portion. These extra parts increase the manufacturing costs and increase the chance of failure of the toothbrush device. Further, since in many of the existing devices toothpaste is deposited directly into the handle of the toothbrush, the devices do not provide for the complete removal of the paste from the system, and therefore fail to reduce the amount of mess and waste of toothpaste.

SUMMARY OF THE INVENTION

The present invention greatly simplifies the manufacturing of a toothbrush device that dispenses dentrifice material or toothpaste to the toothbrush head. The device is configured to allow a vial or cartridge containing toothpaste to be easily inserted into and removed from the receiving portion of the toothbrush device by flexing the receiving portion of the toothbrush. A small catch located on the receiving portion is utilized to hold the cartridge until a plunger is inserted into the cartridge. The toothbrush device utilizes the plunger to hold the cartridge in place and to transfer the toothpaste material from the cartridge to the head of the toothbrush device or the bristles.

This novel toothbrush device also allows for the removal of the cartridge containing the dentrifice material or paste when the cartridge is empty. Once the emptied cartridge is removed from the toothbrush by flexing the receiving portion, a replacement cartridge containing dentrifice material can be inserted into the receiving portion of the toothbrush. The toothbrush may also contain a replaceable bristle portion that is located on the head of the toothbrush. When the bristle portion has been used sufficiently and is no longer in a condition to be used effectively, the used bristle portion may be removed from the toothbrush and discarded and a replacement bristle portion may be attached to the toothbrush device. In this manner, the toothbrush device can be used indefinitely as the paste cartridge and bristle portions are replaced as needed.

In an alternative embodiment, a toothbrush device consists of a non-replaceable packet located in the receiving portion that contains dentrifice material or paste. The toothbrush is configured such that when the non-replaceable paste packet is empty, the entire toothbrush device can be discarded.

BRIEF DESCRIPTION OF THE DRAWINGS

FIG. 5 is an isolated view of FIG. 4 at the point where the cartridge meets the head portion of the dentrifice dispensing toothbrush;

FIG. 6 is a back view of a dentrifice dispensing toothbrush embodying the present invention with the cartridge being inserted into the toothbrush;

FIG. 7 is an alternative embodiment of the present invention;

FIG. 8 is a side view of an alternative embodiment of the present invention.

DETAILED DESCRIPTION OF THE INVENTION

Figure 1:
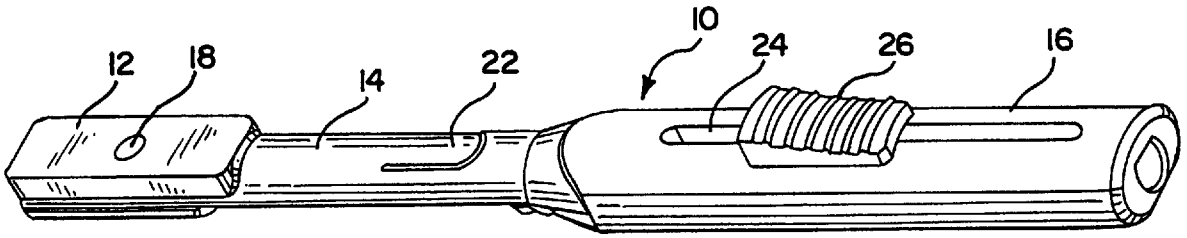
FIG. 1 is a front view of a dentrifice dispensing toothbrush embodying the present invention.

FIG. 1 shows the front view of a dentrifice dispensing toothbrush 10. The toothbrush is manufactured from any type of plastic material that can be formed into this type of device. However, other materials, which are known in the art, may be used in the manufacturing process of the present invention. The toothbrush 10 contains a brush head section 12, a receiving section 14, and a handle section 16. The toothbrush 10 is the approximate size of a standard toothbrush.

The brush head section 12 is located at one end of the toothbrush 10, and is configured to be capable of receiving and supporting a brush assembly (not shown), containing bristles, such that when the brush assembly is attached to the toothbrush 10, the user can brush his teeth. The brush head section 12 and the brush assembly may be configured such that the brush assembly can be attached to the brush head section 12 by sliding and securing the brush assembly over the brush head section 12, by snapping the brush assembly onto the brush head section 12, or in other ways known in the art.

The brush head section 12 contains a hole 18, or holes, and is configured in a way such that dentrifice material or toothpaste (not shown) can be dispensed through the brush head section 12 in order to deliver the toothpaste to the bristles of the brush assembly. As described in detail below, when the dentrifice material is forced out of its container, the material will flow through the brush head section 12 and onto the surface of the bristles which is necessary to brush or clean the teeth.

The Brush head section 12 is attached to the receiving section 14. The receiving section 14 of the toothbrush 10 is configured to be flexible and capable of being flexed in order to allow a dentrifice cartridge 20 (see FIG. 3) to be inserted into the receiving section 14. The receiving section 14 also supports the brush head section 12 when the teeth are being brushed. The receiving section may contain a lever 22, which can be used during the ejection of the dentrifice cartridge 20. As described in more detail below, by placing pressure on the lever 22, the dentrifice cartridge 20 can be ejected (assuming the plunger has been moved to its initial state).

At the end of the receiving section 14, opposite where the brush head section 12 is located, the receiving section 14 is attached to the handle section 16. The toothbrush user holds the handle section 16 while brushing his teeth. The handle section 16 contains a channel 24 running longitudinally along the handle section 16, and a sliding button 26, which is inserted in the channel 24 such that the channel 24 guides the sliding button 26 in a longitudinal direction along the handle section 16. The sliding button 26 is attached to a plunger 28 located inside the handle section 16 (see FIG. 4), such that as the sliding button 26 traverses longitudinally across the handle section 16, the plunger 28 also traverses inside the handle section 16 and the receiving section 14.

The toothbrush 10 described above is meant to be manufactured and assembled and then used an integral device (except for a replaceable brush head 12 or bristles if configured as such). In this manner, the only detachable part is the cartridge 20 (and the brush head 12 or bristles). This simplified configuration reduces the manufacturing costs, and reduces the chance of losing any removable caps, covers or other pieces found in many of the prior art devices. Further, since the toothbrush 10 provides for the clean dispensing of toothpaste without the toothpaste contacting the handle 16 and receiving 14 portions, there is no need to clean toothpaste from the handle 16 or receiving 14 portions of the toothbrush 10 when used properly.

As described in detail below, when a cartridge 20 containing dentrifice material or toothpaste is properly inserted into the receiving section 14 of the toothbrush 10, the toothpaste can be dispensed to the bristles of the brush assembly through the brush head section 12. The dispensing of the toothpaste occurs when the sliding button 26 is moved forward longitudinally along the handle section 16, thereby forcing the plunger 28 to enter into the receiving section 14 and into the cartridge 20. The plunger then forces the toothpaste out of the cartridge 20, through the brush head section 12 and onto the bristles of the brush assembly.

Figure 2:
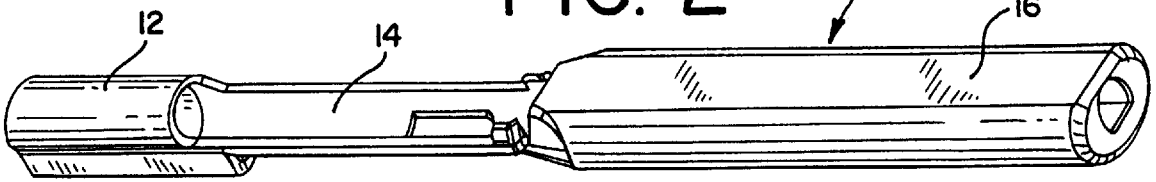
FIG. 2 is a back view of a dentrifice dispensing toothbrush embodying the present invention.

FIG. 2 shows the back side of the toothbrush device 10. As can be seen from the back side, the toothbrush device 10 contains a brush head section 12, a receiving section 14, and a handle section 16. The receiving section 14 of the toothbrush 10 has a cut-away section which allows for the insertion of the dentrifice cartridge 20 (see FIG. 3). As described in detail below, the toothbrush 10 is flexed at the receiving section 14, and the cartridge 20 can be inserted into the receiving section 14 at an angle. The receiving section 14 may contain a catch 30 (see FIG. 6), that provides positive feedback when inserting the cartridge 20.

When the toothbrush 10 is flexed at the receiving section 14, and the cartridge 20 is placed at an angle into the receiving section 14, the catch 30 will act to hold the cartridge 20 in place in the receiving section 14 until the toothbrush 10 is no longer flexed, and the plunger 28 is advanced into the cartridge 20.

Figure 3:
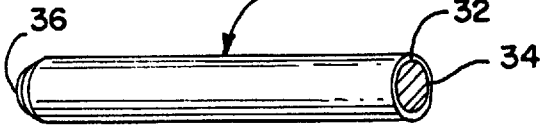
FIG. 3 is a view of a dentrifice containing cartridge embodying the present invention.

FIG. 3 shows a dentrifice cartridge 20 or a vial or cartridge filled with dentrifice material. The cartridge 20 is made of plastic or any suitable material that can be filled with dentrifice material and be placed into the toothbrush device 10 of the present invention. The cartridge 20 can be configured to be disposable once the dentrifice contents are removed, or the cartridge 20 can be configured to be refillable and therefore reusable. The cartridge 20 has a generally flat back end 32 with a stopper 34 located at the back end 32. The stopper may be made of any material that would provide a certain amount of rigidity and at the same time act as a seal in its use. Either rubber, plastic or cork may be used, however, it is conceivable that other materials may be used.

The front end 36 of the cartridge 20 is beveled or angled and contains a hole (not shown) from which the dentrifice material will be dispensed when the sliding button 26 and the plunger 28 are moved forward. The cartridge 20 will originally have a pull tab (not shown), or some other similar cover, covering the hole at the front end 36 to keep the dentrifice material from becoming contaminated. Prior to inserting the cartridge 20 into the receiving section 14 of the toothbrush device 10, the pull tab will be removed and the cartridge 20 will be ready for use.

FIG. 6 shows the insertion of the cartridge 20 into the receiving section 14 of the toothbrush 10. The cartridge 20 is placed into the receiving section 14 of the toothbrush device 10 by first flexing the toothbrush 10 at the receiving section 14. Next, the cartridge 20 is placed at an angle into the receiving section 14 such that the hole located at the front end 36 of the cartridge 20 abuts the brush head section 12 (see close-up of FIG. 5). The front end 36 of the cartridge 20 is beveled or angled in order to make a good seal with the brush head section 12. The cartridge is then pushed into the receiving section 14 until the back end 32 of the cartridge 20 contacts and is held in place by the catch 30.

The sliding button 26 can then be moved forward, which moves the head of the plunger 28 forward from the handle section 16 into the receiving section 14. The head of the plunger 28 presses up against and then pushes the stopper 34 into the cartridge 20 toward the front end 36 of the cartridge 20. This action will operate to lock the cartridge 20 into the receiving section 14. As the sliding button 26 is further moved forward, the head of the plunger 28 will move closer to the front end 36 of the cartridge 20. The cartridge 20 will not be able to be removed until the sliding button 26 and the head of the plunger 28 are moved to their original positions.

Figure 4:
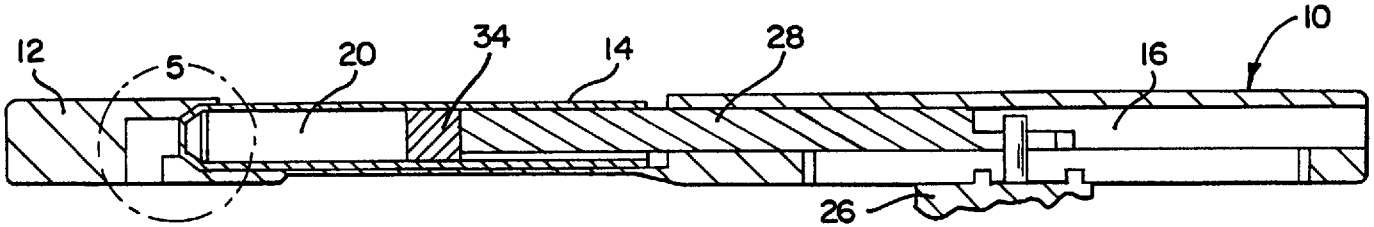
FIG. 4 is a cut away view of FIG. 2 with the cartridge shown in FIG. 3 inserted into the dentrifice dispensing toothbrush.

FIG. 4 is a side view, cut-away figure of the toothbrush device 10 in use. As shown in the figure, the sliding button 26 has been moved partially forward longitudinally along the handle section 16. As such, the plunger 28 has also been moved inside the handle section 16, and the head of the plunger 28, has moved from the handle section 16 into the receiving section 14. The head of the plunger 28 has pushed the stopper 34 forward inside the cartridge 20. The movement of the plunger 28 inside the receiving section 14 creates pressure inside the cartridge 20, which forces the dentrifice material out of the cartridge 20 through the hole at the front end 36 of the cartridge 20 and to the brush head section 12.

When the sliding button 26 and plunger 28 have been moved as far forward as possible, and there is no more dentrifice material remaining in the cartridge 20, the sliding button 26 and the plunger 28 can be returned to their original positions. The plunger 28, which throughout the dispensing process never came in direct contact with the dentrifice material, does not need to be cleaned due to residual dentrifice material. The cartridge 20 can be removed from the receiving section 14 of the toothbrush 10 by flexing the toothbrush 10 at the receiving section 14, and removing the empty cartridge 20 from the toothbrush 10. A new cartridge 20 containing dentrifice material can now be inserted into the toothbrush 10.

FIGS. 7 and 8 show an alternative embodiment of the present invention. The toothbrush 1 10 contains a brush head section 112, a receiving section 114 and a handle section 116. The toothbrush 110 is configured to allow a brush assembly (not shown) to be placed onto the toothbrush 110. The receiving section 114 is hollow and the handle section 116 contains a packet 120 which is closed and is filled with dentrifice material or toothpaste. The handle section 116 is open such that the packet 120 is exposed to having pressure applied.

In order to use the toothbrush device 110, the user applies pressure to the packet containing the dentrifice material 120. The packet 120, which is configured such that when pressure is applied to the packet 120, the dentrifice material is transferred from the packet 120 and dispensed through the receiving section 114 and through the brush head section 112, dispenses toothpaste to the bristles on the brush assembly.

The toothbrush device 110 is meant to be used until the entire contents of the packet 120 has been used and then the toothbrush 110 can be discarded.

The foregoing detailed description of the invention is intended to be illustrative and not intended to limit the scope of the invention. Changes and modifications are possible with respect to the foregoing description, and it is understood that the invention may be practiced otherwise than that specifically described herein and still be within the scope of the claims.

What is claimed is:

1. A toothbrush apparatus for dispensing paste comprising:

a) a head portion, said head portion being generally hollow;

b) a receiving portion, said receiving portion being generally hollow, said receiving portion comprising a first end and a second end, said head portion being attached to said receiving portion at said first end of said receiving portion, said receiving portion being capable of receiving and supporting a paste cartridge, said receiving portion being flexible, thereby allowing for the insertion of said paste cartridge into said receiving portion;

c) a handle portion, said handle portion being attached to said receiving portion at said second end of said receiving portion, said handle portion comprising a plunger and a sliding button, said plunger being located generally inside of said handle portion and being capable of sliding in and out of said receiving portion, said sliding button being located generally on the outside of said handle portion and being connected to and associated with said plunger, said sliding button being capable of sliding on the outside of said handle portion, whereby when said sliding button slides on the outside of said handle portion said plunger moves inside said handle portion and said receiving portion; and d) said paste cartridge having a first end and a second end, said paste cartridge containing a hole located at said first end of said paste cartridge and a stopper located at said second end of said paste cartridge, said paste cartridge being located in said receiving portion of said toothbrush apparatus, such that said first end of said paste cartridge is connected to said head portion and said second end is connected to said handle portion, said paste cartridge being initially filled with paste.

2. The toothbrush apparatus as claimed in claim 1, wherein said plunger is in direct contact with said stopper, whereby when said sliding button slides on the outside of said handle portion said plunger moves inside said paste cartridge forcing said stopper to move from said second end towards said first end.

3. The toothbrush apparatus as claimed in claim 2, wherein when said stopper moves from said second end towards said first end a portion of said paste is transferred form said cartridge into said head portion.

4. The toothbrush apparatus as claimed in claim 1, wherein said head portion further comprises bristles.

5. The toothbrush apparatus as claimed in claim 1, wherein said paste cartridge is inserted after said receiving portion is flexed.

6. The toothbrush apparatus as claimed in claim 1, whereby said paste cartridge is inserted at an offset angle.

7. The toothbrush apparatus as claimed in claim 6, wherein said receiving portion further comprises a catch.

8. The toothbrush apparatus as claimed in claim 7, wherein the paste cartridge is inserted completely into said receiving portion with a snapping action, such that said paste cartridge is held in place by said catch.

9. The toothbrush apparatus as claimed in claim 1, wherein said receiving portion further comprises a lever such that when said plunger is removed from said paste cartridge said lever may be actuated in order to eject said paste cartridge from said toothbrush apparatus.

10. A method of dispensing a paste from a receiving portion of a toothbrush apparatus to a head portion of said toothbrush apparatus, said toothbrush apparatus comprising said head portion, said head portion being generally hollow, a receiving portion, said receiving portion being generally hollow and comprising a first end and a second end, said head portion being attached to said receiving portion at said first end of said receiving portion, a handle portion, said handle portion being attached to said receiving portion at said second end of said receiving portion, said handle portion comprising a plunger and a sliding button, said plunger being located generally inside of said handle portion and being capable of sliding in and out of said receiving portion, said sliding button being located generally on the outside of said handle portion and being connected to and associated with said plunger, said sliding button being capable of sliding on the outside of said handle portion, the method comprising the steps of:

a) inserting a paste cartridge into said receiving portion, said receiving portion containing a catch and a lever, such that when said paste cartridge is inserted into said receiving portion said paste cartridge snaps into place and is held by said catch;

b) sliding said sliding button in a direction toward said head portion, thereby moving said plunger in a direction from said second end of said receiving end toward said first end of said receiving end.

11. The method of dispensing a paste from a receiving portion of a toothbrush apparatus to a head portion of said toothbrush apparatus as claimed in claim 10, further comprising the steps of:

a) sliding said sliding button in a direction away from said head portion, thereby moving said plunger in a direction from said first end of said receiving portion toward said second end of said receiving portion;

b) depressing said lever thereby ejecting said paste cartridge from said receiving portion.

12. A method of dispensing a paste to a head portion of a toothbrush apparatus comprising the steps of:

a) inserting a paste cartridge containing said paste into a receiving portion of a toothbrush apparatus;

b) sliding a sliding button, said sliding button being located on the outside of a handle portion, said sliding button being connected to a plunger, said plunger being located inside said handle portion, whereby when said sliding button slides in a direction towards said head portion said plunger moves in a direction from said second end of said receiving end toward said first end of said receiving end, thereby forcing said paste into said head portion;

c) sliding said sliding button in a direction away from said head portion, thereby moving said plunger in a direction from said first end of said receiving portion toward said second end of said receiving portion; and d) depressing a lever located on said receiving portion thereby ejecting said paste cartridge from said receiving portion.

13. A toothbrush apparatus for dispensing paste comprising a head portion, a handle portion, and a receiving portion, said receiving portion being generally hollow, said receiving portion comprising a first end and a second end, said head portion being attached to said receiving portion at said first end of said receiving portion, said handle portion being attached to said receiving portion at said second end of said receiving portion, said receiving portion being capable of receiving and supporting a paste cartridge, said receiving portion being configured to allow the insertion of a paste cartridge into said receiving portion, said receiving portion further comprising a lever, said lever being configured such that when said lever is depressed the paste cartridge will be ejected from said toothbrush.

* * * * *